US005893276A

United States Patent [19]

Higginbotham

[11] Patent Number: 5,893,276

[45] Date of Patent: Apr. 13, 1999

[54] AIR SEPARATION

[75] Inventor: Paul Higginbotham, Surrey, United Kingdom

[73] Assignee: The BOC Group plc, Windlesham Surrey, United Kingdom

[21] Appl. No.: 08/967,470

[22] Filed: Nov. 11, 1997

[30] Foreign Application Priority Data

Nov. 11, 1996 [GB] United Kingdom ..... 9623519

[51] Int. Cl.[6] ..... F25J 3/00

[52] U.S. Cl. ..... 62/651; 62/924

[58] Field of Search ..... 62/646, 651, 649, 62/652, 924

[56] References Cited

U.S. PATENT DOCUMENTS 4,936,099 6/1990 Woodward et al. ..... 62/652

5,396,772 3/1995 McKeigue ..... 62/652

*Primary Examiner*—Ronald Capossela

*Attorney, Agent, or Firm*—David M. Rosenblum; Salvatore P. Pace

[57] ABSTRACT

Air is separated in a double rectification column comprising a higher pressure rectification column, a lower pressure rectification column, and a condenser-reboiler placing the column in indirect heat exchange relationship with the column. A stream of pressurized liquid, comprising oxygen and nitrogen, typically taken from the bottom of the higher pressure rectification column, is expanded through a valve and is typically partially vaporized in a vaporizer-condenser which is separate from a second vaporizer-condenser in which argon is condensed. The vaporized liquid is expanded with the performance of external work in an expansion turbine and is introduced into the lower pressure rectification column. An oxygen product is withdrawn from the column through an outlet.

15 Claims, 1 Drawing Sheet

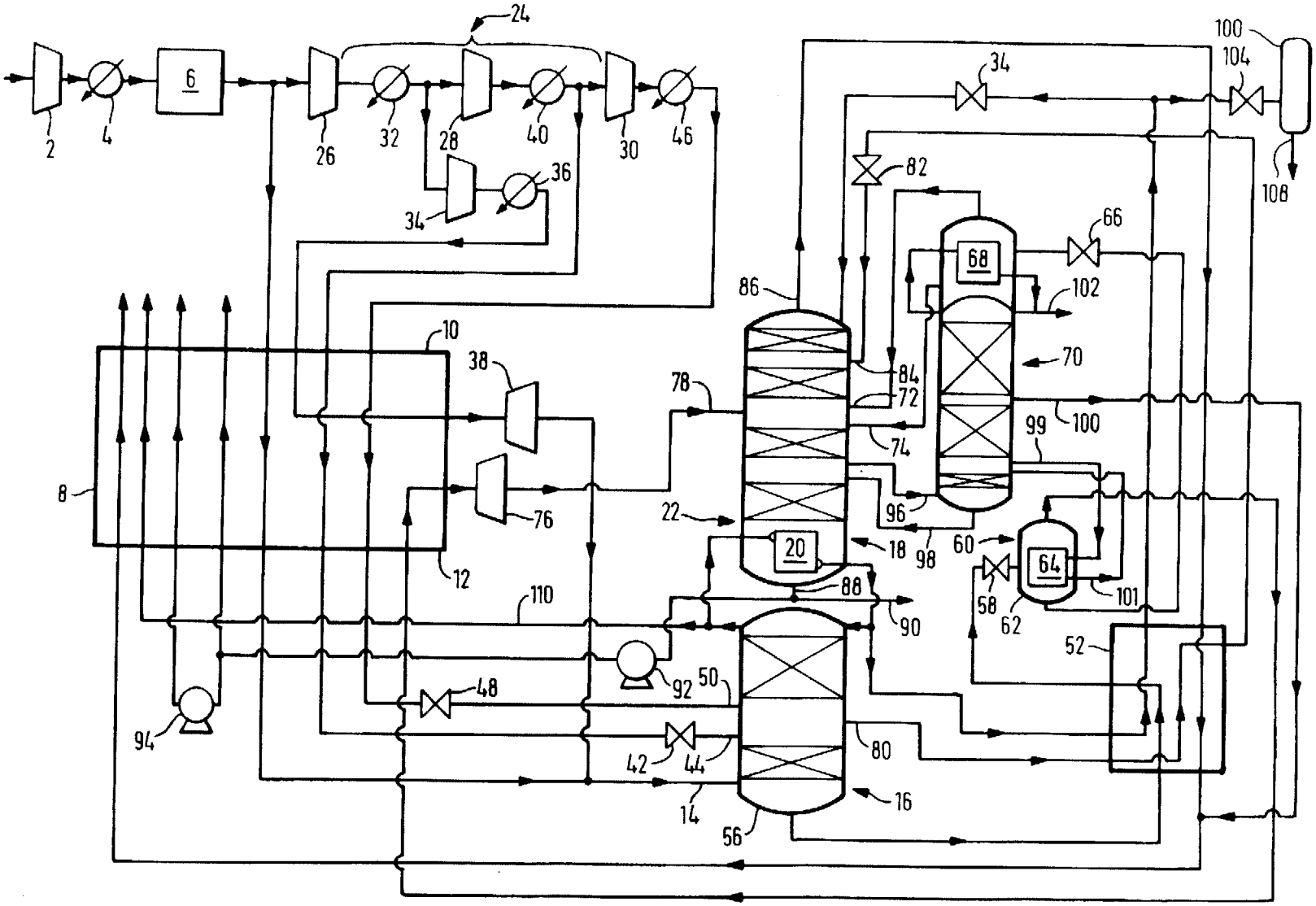
100
104
108
66
102
70
100
99
101
52
64
62
58
60
34
68
82
84
72
74
96
98
18
90
88
80
16
86
20
56
78
22
50
44
14
92
42
46
30
40
36
24
28
34
38
76
110
48
32
26
10
12
6
4
2
8
94

AIR SEPARATION

BACKGROUND OF THE INVENTION

This invention relates to a method and apparatus for separating air.

Air separation by rectification (at cryogenic temperatures) is well known. Typically, in such methods the air is separated in a double rectification column comprising a higher pressure rectification column and a lower pressure rectification column and a condenser-reboiler placing the higher pressure rectification column in heat exchange relationship with the lower pressure rectification column. Such an arrangement enables an oxygen product to be withdrawn from a bottom region of the lower pressure rectification column. In addition, a nitrogen product is typically taken from the top of the lower pressure rectification column.

Normally, a relatively high yield or recovery of oxygen from the incoming air can be achieved by rectification of the air in a double rectification column. However, various demands may be placed on the separation such that the oxygen recovery will fall. Such demands include the production of liquid products in an amount in excess of 5% of the total oxygen production and when refrigeration of the process is provided by turboexpansion of air into the lower pressure rectification column; a requirement for a liquid nitrogen product; and a requirement for a gaseous nitrogen product not only from the lower pressure rectification column but also from the higher pressure rectification column. The demands on the separation process are increased if an argon product is formed by withdrawing an oxygen stream containing argon from the lower pressure rectification column and separating argon from it in a side rectification column. Further, if an argon product is produced, co-production of a nitrogen product from the higher pressure rectification column or co-production of relatively large proportions of liquid products can have a drastic effect on the argon recovery.

U.S. Pat. No. 5,469,710 relates to a relatively conventional air separation method employing a double rectification column and a side column in which an argon product is produced, wherein oxygen-enriched liquid is taken from the bottom of the higher pressure rectification column, is passed through a throttling valve into a condenser in which argon is condensed, the oxygen-enriched liquid thereby being vaporized, and a stream of the resulting vapor is expanded with the performance of external work and introduced into the lower pressure rectification column. Such an arrangement is advantageous in that it is a useful way of providing additional refrigeration for the separation, thereby adding to the flexibility of the method in being able to provide liquid products without unacceptable product recoveries or unacceptable power consumption. The method is, however, limited by the fact that the argon condenser needs to be operated at a pressure less than 2 bar in order to provide the necessary temperature difference for the condensation of argon; therefore the amount of refrigeration that can be produced by expansion to the pressure of the lower pressure rectification column is strictly limited.

It is an aim of the present invention to provide a method and apparatus which is an improvement over those described in U.S. Pat. 5,469,710 and which are capable of being operated even if there is not any argon production.

SUMMARY OF INVENTION

According to the present invention there is provided a method of separating air in a double rectification column comprising a higher pressure rectification column, a lower pressure rectification column, and a condenser-reboiler placing the higher pressure rectification column in heat exchange relationship with the lower pressure rectification column, wherein at least one stream of air is introduced into the double rectification column, a stream of pressurized liquid comprising oxygen and nitrogen is reduced in pressure and is partially or totally vaporized in a vaporizer-condenser separate from any condenser in which argon-rich vapor containing at least 90 mole percent of argon is condensed, a stream of resulting vapor from the partial or total vaporization is expanded with the performance of external work and is introduced into the lower pressure rectification column, and an oxygen product is withdrawn from the lower pressure rectification column.

The invention also provides apparatus for separating air, comprising a double rectification column comprising a higher pressure rectification column, a lower pressure rectification column, and a condenser-reboiler placing the higher pressure rectification column in indirect heat exchange relationship with the lower pressure rectification column; at least one inlet to the double rectification column for at least one stream of air to be separated; a vaporizer-condenser having vaporizing passages in communication via expansion means with a source of pressurized liquid comprising oxygen and nitrogen to be partially or totally vaporized, the vaporizer-condenser being separate from any condenser in which argon-rich vapor containing at least 90 mole percent of oxygen is condensable and being operable to effect the partial or total vaporization; an expansion turbine having an inlet communicating with an outlet for vapor from the vaporizer-condenser and an outlet communicating with the lower pressure rectification column; and an outlet from the lower pressure rectification column for an oxygen product.

The method and apparatus according to the invention make it possible in most examples to vaporize either partially or totally the pressurized liquid stream at a pressure in excess of 2 bar. By partially or totally vaporizing the pressurized liquid stream at a pressure in excess of 2 bar a relatively larger amount of refrigeration is made available to the air separation than in the process described in U.S. Pat. 5,469,710, thereby enabling the air separation to cope better with process requirements that tend to decrease oxygen recovery and/or argon recovery at a given specific power consumption. Further, by partially vaporizing a stream of the pressurized liquid there is effectively an additional stage of separation which enables the method and apparatus according to the invention to be more effective than alternative processes in which a stream of gaseous air is expanded with the performance of external work and is introduced into the lower pressure rectification column. Furthermore, because the expansion turbine exhausts into the lower pressure rectification column there is no need to have any further expansion turbine which permits air to flow to the lower pressure rectification column having by-passed the higher pressure rectification column. Therefore the amount of nitrogen separated in the higher pressure rectification column and hence the amount of reflux produced can be maximized. In addition, the method and apparatus according to the present invention do not require any further rectification column to be associated with the vaporizer-condenser or any condenser to condense the vapor phase formed by the partial vaporization of the pressurized liquid.

A number of further advantages can be achieved in particular examples of the method and apparatus according to the invention, as will be described below.

The stream of pressurized liquid preferably comprises an oxygen-enriched liquid withdrawn from a bottom region of the higher pressure rectification column. Typically, if the pressure at the bottom of the lower pressure column is in the order of 1.4 bar, the pressurized liquid can be partially vaporized at a pressure of about 2.6 bar. A higher partial vaporization pressure can be achieved if the stream of pressurized liquid comprises a stream of liquid withdrawn from an intermediate mass exchange region of the higher pressure rectification column, typically containing from 20 to 22 mole percent of oxygen, or if the stream of pressurized liquid comprises a stream of air which is liquefied or condensed in indirect heat exchange with one or more liquid streams taken from the double rectification column. It is also possible to use a pressurized liquid which comprises a mixture of liquids from two or more of the sources, for example, a mixture of an oxygen-enriched liquid stream withdrawn from a bottom region of the higher pressure rectification column and a stream of liquid withdrawn from an intermediate mass exchange region of the higher pressure rectification column.

The method and apparatus according to the present invention may employ a conventional double rectification column, that is to say the condenser-reboiler reboils a bottom liquid fraction separated in the lower pressure rectification column, the reboiling being effected by indirect heat exchange with a nitrogen vapor fraction that is separated in the higher pressure rectification column. In such examples the stream of pressurized liquid is preferably partially or totally reboiled at a pressure in excess of 2 bar. The method and apparatus according to the present invention are also of use if the double rectification column is of a plural reboiler kind. In such an arrangement the said condenser-reboiler reboils an intermediate fraction separated in the lower pressure rectification column by indirect heat exchange with a stream of nitrogen separated in the higher pressure rectification column. An additional condenser-reboiler reboils a bottom liquid fraction by indirect heat exchange with a stream of vaporous air, the stream of vaporous air thereby being partially or totally condensed. In such examples, the pressure at which the pressurized stream of the liquid mixture is vaporized may be lower than in examples in which a conventional double rectification column is employed, and the vaporization pressure may be as low as 1.8 bar. If desired, a stream of the condensate may be taken as the said stream of pressurized liquid.

If the method and apparatus according to the present invention do not include additional separation of an argon product, the partial vaporization is preferably effected by indirect heat exchange with a stream of nitrogen separated in the higher pressure rectification column, the stream of nitrogen thereby being condensed. The resulting liquid nitrogen may be taken as product or may be used as reflux in the double rectification column in order to compensate for liquid nitrogen product taken therefrom or gaseous nitrogen product taken from the higher pressure rectification column.

The method and apparatus according to the invention are nonetheless particularly suitable for use if an argon product is to be separated, for example, by withdrawing from an intermediate mass exchange region of the lower pressure column a vaporous oxygen stream containing argon (typically containing from 5 to 15% by volume of argon) and separating it in a side rectification column. In such examples of the method and apparatus according to the invention the partial vaporization may be effected by indirect heat exchange with a stream of nitrogen taken from the higher pressure rectification column. Preferably, however, the partial vaporization is effected by indirect heat exchange of the pressurized liquid with one or more of the following streams:

a) a stream of vapor withdrawn from the same region of the lower pressure rectification column as that from which the argon-containing oxygen vapor stream is withdrawn for separation in the side column;

b) a stream of oxygen-enriched vapor withdrawn from a region of the lower pressure rectification column above the region from which the argon-containing oxygen vapor stream is withdrawn for separation in the side column but below that at which oxygen-enriched vapor is introduced into the lower pressure rectification column for separation; and c) a stream of vapor withdrawn from the side rectification column, particularly from an intermediate mass exchange region thereof.

In each of the examples a) to c) above, the vapor stream which is heat exchanged with the partially vaporizing liquid mixture is typically condensed thereby. A stream of the resulting condensate is preferably returned to the region from which the vapor was taken upstream of its condensation.

Preferably, a stream of residual liquid from the partial vaporization is vaporized, preferably in heat exchange with condensing argon separated in the side rectification column, and the resulting vapor is introduced into a chosen region of the lower pressure rectification column above that from which the argon-containing oxygen vapor stream is taken for separation in the side rectification column. Since the partial vaporization has the effect of enriching the residual liquid in oxygen, the vaporized residual liquid stream that is introduced into the lower pressure rectification column has a higher oxygen mole fraction than in comparable conventional processes. As a result, a "pinch" at the region where the vaporized residual liquid stream is introduced into the lower pressure rectification column can be arranged to be at a higher oxygen concentration than the equivalent point in a comparable conventional process. Accordingly, the liquid-vapor ratio in the section of the lower pressure rectification column extending immediately above the region from which the argon-oxygen containing oxygen vapor stream is taken for separation in the side rectification column can be made greater than in the conventional process. Therefore, the feed rate to the side rectification column can be increased. It is thus possible to reduce the concentration of argon in the vapor feed to the side rectification column (in comparison with the comparable conventional process) without sacrificing argon recovery. A consequence of this is that the lower pressure rectification column needs less reboil to achieve a given argon recovery. Thus, for example, the rate of production or the purity of a liquid product from the lower pressure rectification column or the rate of production of a gaseous nitrogen product from higher pressure rectification column may be enhanced.

Any conventional refrigeration system may be employed in addition to the said expansion turbine to meet the refrigeration requirements of a method and apparatus according to the invention. These requirements will vary, for example, according to the ratio of the sum of the rates of production of liquid products to the total rate of production of oxygen product. If this ratio is above, say, 0.15 to 1, the refrigeration system preferably includes a turbine which has an inlet communicating with the source of air and an outlet which communicates with the higher pressure rectification column. If a pressurized, gaseous oxygen product is formed by vaporizing and warming a pressurized liquid oxygen stream in indirect heat exchange relationship with one or more return streams from the double rectification column, there will also be a need to produce an air stream at an appropriately high pressure.

Typically, there is a vaporous air feed to the higher pressure rectification column which is preferably taken from a source of compressed air which has been purified by extraction therefrom of water vapor, carbon dioxide, and, if desired, hydrocarbons, and which has been cooled in indirect heat exchange with products of the air separation. There is also typically a liquefied air feed to one or both of the higher pressure and lower pressure rectification columns which is preferably formed in an analogous manner.

Each rectification column may comprise a distillation or fractionation zone or zones, wherein liquid and vapor phases are countercurrently contacted to effect separation of the fluid mixture, as for example, by contacting the vapor and liquid phases on packing elements or a series of vertically spaced trays or plates mounted within the column, zone or zones. A rectification column may comprise a plurality of zones in separate vessels so as to avoid having a single vessel of undue height. For example, it is known to use a height of packing amounting to 200 theoretical plates in an argon rectification column. If all this packing were housed in a single vessel, the vessel might typically have a height of over 50 meters. It is therefore obviously desirable to construct the argon rectification column in two separate vessels so as to avoid having to employ a single, exceptionally tall, vessel.

BRIEF DESCRIPTION OF THE DRAWINGS

The method and apparatus according to the invention will now be described by way of example with reference to the accompanying drawing which is a schematic flow diagram illustrating an air separation plant. The drawing is not to scale.

DETAILED DESCRIPTION OF THE INVENTION

Referring to the drawing, a flow of air is compressed in a main air compressor 2 and has heat of compression removed therefrom in an aftercooler 4. The resulting aftercooled, compressed, air stream is purified in unit 6 by removal of water vapor, carbon dioxide and typically hydrocarbons therefrom. Unit 6 may effect this purification by temperature swing adsorption, pressure swing adsorption or other adsorptive gas purification method. The resulting purified air stream is divided into two flows. One flow passes through a main heat exchanger 8 from its warm end 10 to its cold end 12 and is thereby cooled to a temperature close to its dew point such that the flow can be separated by rectification at cryogenic temperatures. The thus cooled flow of air is introduced in vaporous state through an inlet 14 into a bottom region of a higher pressure rectification column 16. The higher pressure rectification column 16 forms with a lower pressure rectification column 18 and a condenser-reboiler 20, a double rectification column indicated generally by the reference numeral 22.

The other flow of purified air is sent to a first booster-compressor 24 which includes compression stages 26, 28 and 30. Downstream of the stage 26 the other flow of purified air is cooled in an aftercooler 32 so as to remove the heat of compression. This aftercooled flow of compressed air is divided again into two subsidiary streams. The first of these subsidiary streams flows to a second booster-compressor 34 in which it is yet further compressed. The resultant yet further compressed subsidiary air stream is cooled in an aftercooler 36 so as to remove heat of compression therefrom and flows through the main heat exchanger 8 from its warm end 10 to an intermediate region thereof. The yet further compressed first subsidiary stream is withdrawn from the main heat exchanger 8 at a first intermediate temperature typically in the order of 150K and is expanded with the performance of external work in an expansion turbine 38. The thus expanded air flow exits the expansion turbine 38 at essentially the pressure at the bottom of the higher pressure rectification column 16 and at a temperature a little above its dew point. This air stream is mixed with the flow of air that enters the higher pressure rectification column 16 through the inlet 14. The external work performed by the turbine 38 is used to drive the second booster-compressor 34. To this end, the rotor (not shown) of the expansion turbine 38 may be mounted on the same shaft as the rotor (not shown) of the second booster-compressor 34.

The second subsidiary air flow from the aftercooler 32 flows to the compression stage 28 of the first booster-compressor 24 and is again further compressed therein. The resulting air exits the second stage 28 and is cooled in an aftercooler 40 so as to remove its heat of compression. The flow of air from the aftercooler 40 is yet again divided into two parts. One part flows through the main heat exchanger 8 from its warm end 10 to its cold end 12, from where it flows through a throttling valve 42. This air flow leaves the throttling valve 42 at least in part in liquid state and is introduced into an intermediate mass exchange region of the higher pressure rectification column 16 through an inlet 44.

The other part of the air leaving the aftercooler 40 flows through the final stage 30 of the first booster-compressor 24 in which it is compressed to the highest pressure that obtains in operation of the apparatus shown in the accompanying drawing. The resulting stream of compressed air is cooled in an aftercooler 46 so as to remove its heat of compression. The cooled air flows from the aftercooler 46 through the main heat exchanger 8 from its warm end 10 to its cold end 12, from where it flows through another throttling valve 48. The air stream leaves the throttling valve 48 at least in part in liquid state and enters the higher pressure rectification column 16 through an inlet 50 which is typically located at the same level of the column 16 as the inlet 44.

The air that enters the higher pressure rectification column 16 is separated therein into a bottom oxygen-enriched liquid air fraction and a top vaporous nitrogen fraction. A first flow of the vaporous nitrogen fraction passes into the condenser-reboiler 20 and is condensed therein. A part of the resulting condensate is returned to the top of the higher pressure rectification column 16 as reflux. Another part of the condensate flows through a further heat exchanger 52 in which it is sub-cooled. At least a part of the resultant sub-cooled liquid nitrogen condensate passes through a throttling valve 54 into a top region of the lower pressure rectification column 18 and provides reflux for the column 18.

A stream of the bottom oxygen-enriched liquid air fraction is withdrawn under pressure from the higher pressure rectification column 16 through an outlet 56, is sub-cooled by passage through the heat exchanger 52, is passed through a throttling valve 58 and flows into a vaporizer-condenser 60 at a pressure in excess of 2 bar. The vaporizer-condenser 60 comprises a vessel 62 in which is located a heat exchange block 64. A sufficient volume of oxygen-enriched liquid air is maintained within the vessel 62 such that the heat exchange block 64 is immersed therein. Liquid flows through boiling passages (not shown) in the heat exchange block 62 by virtue of a thermosiphon effect. As a result, liquid is partially vaporized. The resultant vapor phase disengages from the residual liquid. By virtue of the partial vaporization, the liquid within the vessel 62 is further enriched in oxygen while the vapor phase is depleted of oxygen relative to the liquid that enters the vessel 62. A stream of the further enriched liquid air flows out of the bottom of the vessel 62 and is further reduced in pressure by passage through a throttling valve 66. The resulting throttled further-enriched liquid flows into a condenser 68 (also referred to herein as the second vaporizer-condenser) which is operatively associated with a side rectification column 70 and which condenses argon vapor separated in the side rectification column 70. As a result of this condensation, the further-enriched liquid stream is either partially or totally vaporized. As shown in the drawing, a stream of the resulting vapor flows from the condenser 68 through an inlet 72 into a chosen intermediate location of the lower pressure rectification column 18 and a stream of residual liquid flows from the condenser 68 through an inlet 74 into the same location of the lower pressure rectification column 18.

The vapor phase from the vaporizer-condenser 60 flows from the top of the vessel 62 through the main heat exchanger 8 from its cold end 12 to a chosen intermediate region thereof at which its temperature is in the order of 105K. The vapor stream is withdrawn from the main heat exchanger 8 at this temperature and is expanded with the performance of external work in a second expansion turbine 76. A vapor stream leaves the turbine 76 at essentially the operating pressure of the lower pressure rectification column 18 and at approximately its dew point. This vapor stream flows into the lower pressure rectification column 18 through an inlet 78 which is typically located at the same general level as the inlets 72 and 74 but which may, if desired, be located a few theoretical trays thereabove.

If desired, in order to generate additional refrigeration, the vapor stream withdrawn from the top of the vessel 62 may instead of passing only a part of the way through the main heat exchanger 8 flow all the way through the main heat exchanger 8 from its cold end 12 to its warm end 10, be compressed in another booster-compressor (not shown), be cooled in another aftercooler (not shown), be further cooled by passage through the main heat exchanger 8 from its warm end 10 to a chosen intermediate location thereof and only then introduced into the expansion turbine 76. Although additional refrigeration may thereby be generated, the added capital expense and thermodynamic inefficiencies of providing an additional pass through the main heat exchanger 8 and a further booster-compressor will detract from the advantage of the additional refrigeration provided, and for this reason the arrangement shown in the drawing is generally preferred.

The vaporizer-condenser 60 is not the only source of oxygen-nitrogen-argon mixture for separation in the lower pressure rectification column 18. A liquid stream, typically having essentially the same composition as air, is withdrawn through an outlet 80 from an intermediate mass exchange region of the higher pressure rectification column 16 and flows through the heat exchanger 52, thereby being sub-cooled. This sub-cooled liquid air stream flows through a throttling valve 82 and is introduced into a chosen intermediate mass exchange region of the lower pressure rectification column 18 through an inlet 84 which is typically located above the level of the inlets 72 and 74. This liquid stream enhances the reflux ratio in the section of the lower pressure rectification column 18 immediately below the level of the inlet 84. The air is separated in the lower pressure rectification column 18 into a bottom liquid oxygen fraction and a top vaporous nitrogen fraction. The bottom liquid oxygen fraction is partially reboiled in the condenser-reboiler 20 by indirect heat exchange with the condensing nitrogen therein. Vapor flow upwardly through the column 18 is thereby created. A gaseous nitrogen product is formed by withdrawing a stream of the top nitrogen vapor from the lower pressure rectification column 18 through an outlet 86. This nitrogen stream flows through the heat exchanger 52 countercurrently to the streams being sub-cooled therein and is thereby warmed. The nitrogen stream is further warmed by passage through the main heat exchanger 8 from its cold end 12 to its warm end 10. A liquid oxygen stream is withdrawn from the bottom of the lower pressure rectification column 18 through an outlet 88. The stream is sub-divided. One part flows via a conduit 90 to a liquid oxygen storage facility (not shown). The remainder of the liquid oxygen stream is pressurized by a pump 92 to a chosen elevated pressure and flows through the main heat exchanger 8 from its cold end 12 to its warm end 10. A relatively high pressure gaseous oxygen product is thereby formed. If desired, as shown in the drawing, an additional high pressure oxygen product at even higher pressure may be formed by withdrawing a part of the pressurized liquid oxygen stream from upstream of the cold end 12 of the main heat exchanger 8 and pressurizing to an even higher pressure in a further pump 94. The further pressurized liquid oxygen stream flows through the main heat exchanger 8 from its cold end 12 to its warm end 10 and is taken from the warm end 10 as a high pressure gaseous oxygen product.

In order to produce an argon product an argon-enriched oxygen stream is withdrawn from a chosen region of the lower pressure rectification column 18 where the argon concentration is in the range of 5 to 15% by volume and flows via conduit 96 into the bottom of the side rectification column 70. An argon product containing at least 90 mole percent of argon is separated in the side rectification column 70. The argon product preferably contains at least 97% by volume of argon, and, more preferably, contains less than 100 volumes per million of oxygen and other impurities. In order to achieve such a high purity level, the side rectification column 70 typically contains in the order of 200 theoretical stages which, although not shown in the drawing, are preferably housed in two separate vessels in a manner well known in the art. In the arrangement shown in the drawing, because the demand for argon is less than that which the illustrated plant would otherwise be capable of providing, a relatively small waste argon stream is withdrawn from an intermediate mass exchange region of the side rectification column 70 through an outlet 100 and is typically mixed with the gaseous nitrogen stream intermediate the heat exchanger 52 and the cold end 12 of the main heat exchanger 8. The withdrawal of this waste argon stream has the effect of increasing the liquid-vapor ratio in the top section of the side rectification column 70, which (as shown) is above the level of the outlet 100 and thereby enables the number of theoretical stages in, and hence the height of this section, to be reduced in comparison with what it would otherwise be were the waste argon stream not to be formed.

Typically, the argon vapor flows from the top of the side rectification column 70 into the condenser 68 and is condensed therein. A part of the resulting condensate is returned to the column 70 as reflux and the remainder taken via conduit 102 as product. If desired, this product liquid argon may be further purified by any method known in the art, for example by further rectification in order to strip nitrogen impurity therefrom. In an alternative arrangement, which is not shown in the drawing, a part of the argon vapor may be taken as product and all the condensed argon returned to the side rectification column 70 as reflux. In a yet further arrangement which is also not shown in the drawing, both vaporous and condensed argon products may be taken.

A liquid oxygen stream containing argon is returned from the bottom of the side rectification column 70 via a conduit 98 to the region of the lower pressure rectification column 18 from which the argon-enriched oxygen stream is withdrawn. In addition, a vapor stream is withdrawn from an intermediate mass exchange region of the side rectification column 70 via conduit 99, is employed to provide the necessary heat to the heat exchange block 64 so as partially to vaporize the oxygen-enriched liquid air stream that is sent to the vaporizer-condenser, and is returned via a conduit 101 to the same region of the side rectification column as that from which the vapor stream is withdrawn.

If desired, the plant shown in the drawing may also provide a liquid nitrogen product. To this end, a part of the sub-cooled liquid nitrogen stream instead of being sent to the throttling valve 54 may be passed through a further throttling valve 104 into a liquid nitrogen storage vessel 106 having a bottom outlet 108.

If desired, the plant shown in the drawing may additionally produce a relatively high pressure gaseous nitrogen product. To this end, a part of the nitrogen vapor separated in the higher pressure rectification column 16 flows via a conduit 110 to the main heat exchanger 8 and is warmed therein by passage from its cold end 12 to its warm end 10.

In a typical example of the operation of the plant shown in the drawing, the main compressor 2 has an outlet pressure of approximately 5.8 bar, the booster-compressor stage 26 an outlet pressure of 19 bar, the booster-compressor stage 28 an outlet pressure of 32 bar, and the booster-compressor stage 30 an outlet pressure of 53 bar. In this example, the booster-compressor 34 may have an outlet pressure of 36 bar. The higher pressure rectification column 16 is operated at a pressure of 5.5 bar at its bottom, the lower pressure rectification column 18 and the side rectification column 70 both have a bottom pressure of approximately 1.4 bar, and the vaporizer-condenser 60 is operated at a pressure of about 2.6 bar. If desired, liquid oxygen, liquid nitrogen and liquid argon and pressurized gaseous nitrogen products may all be produced. In the above-mentioned example the production of the liquid oxygen product is 7.1 mole percent of the total production of oxygen product; the production of the liquid nitrogen product is 8.2 mole percent of the total production of oxygen product; the production of liquid argon product is 2 mole percent of the total production of oxygen product, and the production of the pressurized nitrogen product via conduit 110 is 40 mole percent of the total production of oxygen product. In this example the argon recovery is approximately 45%.

I claim:

1. A method of separating air in a double rectification column comprising a higher pressure rectification column, a lower pressure rectification column, and a condenser-reboiler placing the higher pressure rectification column in heat exchange relationship with the lower pressure rectification column, comprising:

introducing at least one stream of air is introduced into the double rectification column;

reducing pressure of a stream of pressurized liquid comprising oxygen and nitrogen and at least partially partially vaporizing said stream in a vaporizer-condenser separate from any condenser in which argon-rich vapor containing at least 90 mole percent of argon is condensed;

expanding with the performance of external work a vapor stream produced from vaporization of said stream of pressurized liquid and introducing said vapor stream into the lower pressure rectification column; and withdrawing an oxygen product is withdrawn from the lower pressure rectification column.

2. The method as claimed in claim 1, in which the stream is at least partially vaporized at a pressure in excess of about 2 bar.

3. The method as claimed in claim 1, in which the stream is withdrawn from a bottom region of the higher pressure rectification column.

4. The method as claimed in claim 1, in which no argon product is separated and the at least partial vaporization of the stream of pressurized liquid is effected by indirect heat exchange with a stream of nitrogen separated in the higher pressure rectification column, the stream of nitrogen thereby being condensed.

5. The method as claimed in claim 1, in which a vaporous oxygen stream containing argon is withdrawn from an intermediate mass exchange region of the lower pressure rectification column and has argon separated from it in a side rectification column.

6. The method as claimed in claim 5, in which the at least partial vaporization of the stream of pressurized liquid is effected by indirect heat exchange of the stream of pressurized liquid with at least one of a lower pressure rectification column stream of vapor withdrawn from the same region of the lower pressure rectification column as that from which the argon-containing oxygen vapor stream is withdrawn from separation in the side column and an oxygen-enriched stream of oxygen-enriched vapor withdrawn from a region of the lower pressure rectification column above the region from which the argon-containing oxygen vapor stream is withdrawn for separation in the side column but below that at which oxygen-enriched vapor is introduced into the lower pressure rectification column for separation.

7. The method as claimed in claim 5, in which a residual stream of residual liquid from the at least partial vaporization is vaporized and the resulting vapor is introduced into a chosen region of the lower pressure rectification column above that from which the argon-containing oxygen vapor stream is taken for separation in the side rectification column.

8. The method as claimed in claim 7, in which the residual stream of residual liquid is vaporized in heat exchange with condensing argon separated in the side rectification column.

9. An apparatus for separating air, comprising:

a double rectification column comprising a higher pressure rectification column, a lower pressure rectification column, and a condenser-reboiler placing the higher pressure rectification column in indirect heat exchange relationship with the lower pressure rectification column;

at least one inlet to the double rectification column for at least one stream of air to be separated;

a vaporizer-condenser having vaporizing passages in communication via expansion partially or totally vaporized, the vaporizer-condenser being separate from any condenser in means with a source of pressurized liquid comprising oxygen and nitrogen to be which argon-rich vapor containing at least 90 mole percent of argon is condensable and being operable to effect the partial or total vaporization;

an expansion turbine having a turbine inlet communicating with a vapor outlet for vapor from the vaporizer-condenser and a turbine outlet communicating with the lower pressure rectification column; and a lower pressure rectification column outlet from the lower pressure rectification column for an oxygen product.

10. The apparatus as claimed in claim 9, in which the expansion means is a valve.

11. The apparatus as claimed in claim 9, in which the source of the pressurized liquid is the bottom of the higher pressure rectification column.

12. The apparatus as claimed in claim 9, additionally including a side rectification column for separating argon from an argon-containing oxygen vapor stream communicating with an intermediate mass exchange region of the lower pressure rectification column.

13. The apparatus as claimed in claim 12, which the vaporizing passages of the vaporizer-condenser communicate at least one of the same intermediate mass exchange region of the lower pressure rectification column as that with which the side rectification column communicates, an intermediate mass exchange region of the lower pressure rectification column above that with which the side rectification column communicates but below that with which an inlet for oxygen-enriched vapor communicates, and an intermediate mass exchange region of the side rectification column.

14. The apparatus as claimed in claim 12, in which the lower pressure rectification column has an inlet for argon-enriched vapor communicating with an outlet from the vaporizing passages of a second vaporizer-condenser, the vaporizing passages of the second vaporizer-condenser having an inlet communicating with a vessel for receiving residual liquid from the vaporizing passages of the first vaporizer-condenser.

15. The apparatus as claimed in claim 14, in which the condensing passages of the second vaporizer-condenser communicate with an argon-rich region of the side rectification column.

* * * * *